United States Patent [19]

Tomizu et al.

[11] Patent Number: 4,795,863

[45] **Date of Patent: * Jan. 3, 1989**

[54] ELECTRICAL SWITCH

[75] Inventors: Motoyuki Tomizu; Kunio Nagata, both of Otokuni, Japan

[73] Assignee: Omron Tateisi Electronics Co., Japan

[ * ] Notice: The portion of the term of this patent subsequent to Jul. 21, 2004 has been disclaimed.

[21] Appl. No.: 818,237

[22] Filed: Jan. 13, 1986

Related U.S. Application Data

[63] Continuation-in-part of Ser. No. 641,560, Aug. 16, 1984, Pat. No. 4,564,730.

[30] Foreign Application Priority Data

| | | | |
|---|---|---|---|
| Aug. 16, 1983 | [JP] | Japan | 58-127136[U] |
| Aug. 23, 1983 | [JP] | Japan | 58-130721[U] |
| Sep. 16, 1983 | [JP] | Japan | 58-143772[U] |
| Sep. 22, 1983 | [JP] | Japan | 58-146776[U] |

[51] Int. Cl.[4] ..... H01H 15/00; H01H 3/16; H01H 13/10

[52] U.S. Cl. ..... 200/16 B; 200/61.76; 200/531

[58] Field of Search ..... 200/16 B, 16 D, 16 E, 200/52 R, 61.76–61.83, 61.85, 159 R, 275, 276, 340

[56] References Cited

U.S. PATENT DOCUMENTS

| | | | |
|---|---|---|---|
| 2,065,904 | 12/1936 | Meuer | 200/61.76 X |
| 2,132,428 | 10/1938 | Meuer | 200/61.76 X |
| 2,155,765 | 4/1939 | Meuer | 200/61.76 |
| 4,564,730 | 1/1986 | Tomizu et al. | 200/61.76 X |
| 4,681,994 | 7/1987 | Nagata et al. | 200/16 B |

*Primary Examiner*—J. R. Scott

*Attorney, Agent, or Firm*—Wegner & Bretschneider

[57] ABSTRACT

An electrical switch which includes a casing, a pair of fixed contacts each formed by cutting a rod member into a predetermined length, and disposed in the casing to confront each other, a plunger slidably accommodated in the casing for movement in an axial direction, bearing members slidably supporting the plunger, a movable contact formed by cutting a rod member into a predetermined length and mounted to an intermediate portion of the plunger in a direction intersecting with the fixed contacts, and a return spring directed around the outer periphery of the plunger. The movable contact is restored together with the plunger to close the pair of fixed contacts in a free state.

3 Claims, 2 Drawing Sheets

ELECTRICAL SWITCH

BACKGROUND OF THE INVENTION

This application is a continuation-in-part of application Ser. No. 641,560, filed Aug. 16, 1984, now U.S. Pat. No. 4,564,730.

The present invention generally relates to an electrical switch and more particularly, to a high precision electrical switch of a small size.

Conventionally, for electrical switches with contacts employed, for example, for detecting positions of various objects, there have been employed a switch which adopts a reversing mechanism and that which utilizes a leaf contact, etc. However, each of the such known switches, which employs a plate spring, has such a disadvantage that scattering of functioning positions of the contacts thereof tends to be large.

In order to eliminate the inconvenience as described above, there has also been conventionally proposed an electrical switch which is so arranged that an electrically conductive spherical member urged by a return spring contacts a pair of fixed contacts for constituting normally closed contacts, while the spherical member is adapted to be spaced from the respective fixed contacts against the urging force of the return spacing by depressing a plunger.

The known switch arrangement as described above, however, still has such drawbacks that not only cost of the switch becomes high due to employment of the spherical member, but also the switch itself tends to be large in size, since the plunger, spherical member (movable contact), and return spring are aligned, as it were, in series. Meanwhile, the sliding span or distance of the plunger should preferably be as long as possible for stable operation, with a less adverse effect to accuracy due to a looseness or side play, but in the switch arrangement referred to above, if the sliding span is set to be long, the size of the switch itself is inevitably increased, and thus, a sufficiently long span cannot be provided for achieving a high accuracy.

SUMMARY OF THE INVENTION

Accordingly, an essential object of the present invention is to provide an improved small-sized and high precision electrical switch, with a substantial elimination of disadvantage inherent in the conventional electrical switches of this kind.

Another important object of the present invention is to provide an electrical switch of the above described type which is simple in construction and stable in functioning at high reliability, and can be produced on a large scale at low cost.

In accomplishing these and other objects, according to one preferred embodiment of the present invention, there is provided an electrical switch which comprises a casing, a pair of fixed contacts each formed by cutting a rod member into a predetermined length, and disposed in the casing to confront each other, a plunger slidably accommodated in the casing for movement in an axial direction, bearing members slidably supporting the plunger, a movable contact formed by cutting a rod member into a predetermined length and mounted to an intermediate portion of the plunger in a direction intersecting with the fixed contacts, and a restoring means directed around the outer periphery of the plunger. The movable contact is adapted to be returned together with the plunger to close the pair of fixed contacts in a free state.

More specifically, in the above arrangements of the present invention, since the movable contacts, the pair of fixed contacts, and the restoring means e.g. a return spring, etc. are provided at the intermediate portion of and around the plunger, with the plunger being slidably supported by the bearing members, the switch may be constructed to be extremely compact in the longitudinal direction of the plunger, and owing to the facts that the sliding span of the plunger may be set comparatively long, while the contacts are formed into a cross bar construction through employment of rod members, highly accurate functionings of the contacts may be achieved. Moreover, by forming the contacts from the rod members, the overall cost for the switch may be appreciably reduced.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
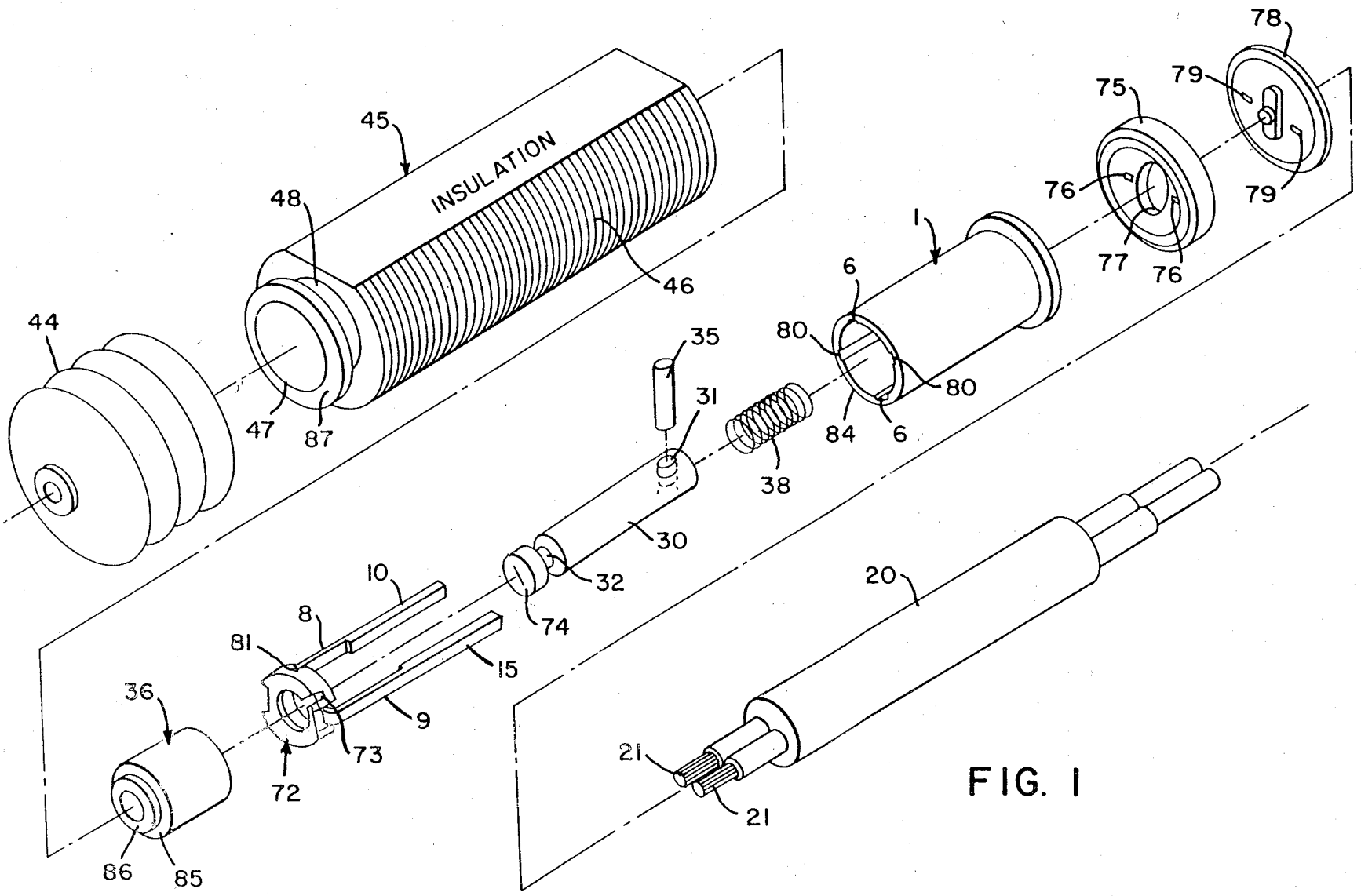
FIG. 1 is an exploded perspective view of an electrical switch according to one preferred embodiment of the present invention.

Before the description of the present invention proceeds, it is to be noted that like parts are designated by like reference numerals throughout the accompanying drawings.

Figure 2A:
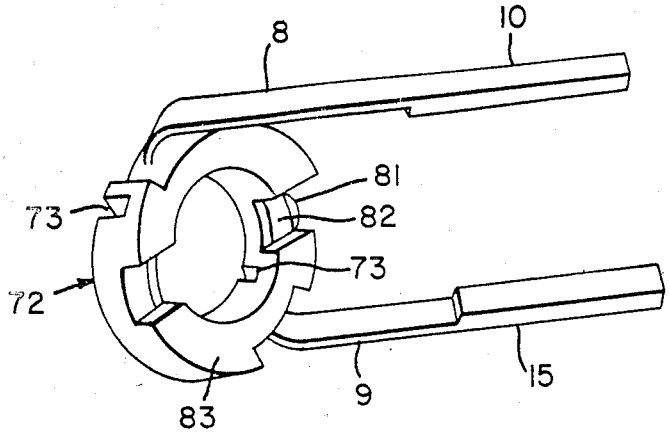
FIG. 2A is a detailed exploded perspective view of the fixed contact-lead piece-receiving base assemblage seen in FIG. 1.

Referring now to the drawings, there is shown in FIGS. 1 and 2 an electrical switch according to one preferred embodiment of the present invention, which generally includes an inner casing 1, fixed contacts 8 and 9, lead terminals 10 and 15, a plunger 30, a movable contact 35, a bearing member 36, a return spring 38, and an outer casing 45.

The inner casing 1 is molded as one unit by a proper synthetic resin or the like, and the lead terminals 10 and 15 are attached to fixed contacts 8 and 9 with a resin so as to form single, linear bars. Resin is further provided so as to act as insulation between the lead pieces. Resin is also situated on the posterior surface of a support base 72 which is intersecting a plane perpendicular to the length of the lead pieces 10 and 15 as shown as resin coat 83 in FIG. 2A. The bars formed of fixed contact 8 and 9 and lead pieces 10 and 15 are situated in a parallel condition to each other by means of attachment to support base 72. These bars are aligned in a 180 degree position to each other with regards to the radius of the support base 72. As can be seen most clearly in FIGS. 2A and 2B, the fixed contacts 8 and 9 are secured in the support base 72.

On the other hand, the plunger 30 is slidably provided in the central bore 2 of the inner casing 1 through bearing member 36 made, for example, of ceramics, with the movable contact 35 being inserted into a hole 31 formed at approximately an intermediate portion of said plunger 30. This movable contact 35 is prepared by cutting a contact material in the form of a round rod to a predetermined length, and is positioned in a direction to intersect with the fixed contacts 8 and 9, while within the central bore 2, groove portions 6 are formed so as to allow the opposite end portions of the movable contact 35 to be displaced. A return spring 38 in a coil-like shape is disposed in a compressed state between a face of the inner casing 1 and the plunger 30 so as to normally urge the movable contact 35 and the plunger 30 for providing a contact pressure by which the movable contact 35 is held in pressure contact with the fixed contacts 8 and 9.

Figure 2B:
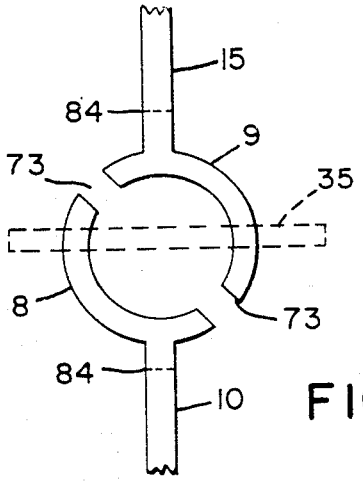
FIG. 2B is a cross-sectional view of the fixed contact as seen in FIGS. 1 and 2A, but in its unassembled state.

The fixed contacts 8 and 9 are made of metal sheeting in the form shown in FIG. 2B, and when folded along folding lines 84 are so shaped as to be easily disposed into support base 72. The position of the movable contact 35 in the contact position is designated by the broken line silhouette shown in FIG. 2B. The support base 72 is provided with movable contact receiving holes 81. The moveable contact receiving holes 81 serve to expose the face of the fixed contact, that is exposed face 82 shown in FIG. 2A. In the resting position of the switch, the ends of the movable contact 35 are accommodated in the holes 81 due to the depressing force of the return spring 38. In this position, a short-circuiting results between the lead pieces 10 and 15 through their contact with the fixed contact exposed faces 82, situated at the rear of the movable contact receiving hole 81. The support base 72 is noted with half cuts 73, which are parallel to and disposed between the fixed contacts 8 and 9 and the movable contact receiving hole 81. In the assembled state, the fixed contacts 8 and 9 are exposed at their central portions to confront each other.

An end face 74 is provided at the end of the plunger 30 distal from the movable contact 35. Return spring 38 directly contacts the movable contact 35. The end face 74 of plunger 30 is exposed at the forward end of the rubber cap. When the switch device is in its activated position, plunger 30 causes the depression of the spring 38. The movable contact 35 and the fixed contacts 8 and 9 are no longer in contact in this position. This causes the lead pieces 11 and 15 to be insulated from each other.

On the other hand, the outer casing 45 is made of a metallic cylinder, with a female thread 46 partly eliminated by a flat plane being formed on the outer peripheral surface thereof. The inner casing 1, etc. described earlier are inserted into the outer casing 45 from its rear end opening thereof, and accommodated in the outer casing 45, with the forward end portion of the plunger 30 being projected out of an opening 47 of said outer casing 45. Into an annular groove 48 of the outer casing 45 and another annular groove 32 formed at the forward end of the plunger 30, a bellows-like expansion and contraction rubber member 44 is fitted for sealing of the opening 47.

In the above arrangement, the movable contact 35 normally contacts the fixed contacts 8 and 9 by the spring force of the return spring 38 to keep the switch in the closed state. Upon depression of the plunger 30, the movable contact 35 is also displaced together with the plunger 30 against the spring force of the return spring 38, and thus, the fixed contacts 8 and 9 are spaced from the movable contact 35 for opening.

The electrical switch according to the present invention as described above may be mounted on a panel (not shown) or the like, by inserting the outer casing 45 into a mounting hole (not shown) of the panel, etc. and engaging nuts (not shown) onto the female thread 46 thereof from the front side and rear side of the panel.

More specifically, in the electrical switch of the present invention, the fixed contacts 8 and 9 are immediately opened upon depression of the plunger 30, with the movement up to the functioning (PT) being zero, while by forming the cross bar contacts by the round bar as the contact material, the functioning accuracy of the contacts has been remarkably improved. Moreover, since the plunger 30 is supported at the opposite ends by the bearing member 36 and sealing packing 75, influences due to a side play resulting from dimensional errors, etc. may be eliminated as far as practicable.

Meanwhile, since the movable contact 35 is provided at approximately the intermediate portion of the plunger 30, while the return spring 38 and the fixed contacts 8 and 9 are disposed around the plunger 30, the space is efficiently utilized to constitute a switch of a compact size. Furthermore, by forming the contact 35 from a rod material, especially a round rod, and the contacts 8 and 9 and terminals 10 and 15 from sheet material, the switch may be produced at low cost.

A special feature of the preferred embodiment is that hole 31 is tapered in such a way as to allow some movement of the movable contact 35 in regards to the support base 30. This movement allows the movable contact 35 to conform to irregularities which may occur in the alignment or structure of fixed contacts 8 and 9 during manufacture or usage, and especially to the exposed face of the fixed contacts 82. The tapering of hole 31 advantageously allows the movable contact 35 to be sufficiently abutted to fixed contacts 8 and 9 to avoid defects in switch functioning due to faulty contact. Thus, wear patterns and force vectors must be taken into account when selecting the most beneficial shape for hole 31. The use of tapering also serves to reduce the friction between movable contact 35 and hole 31, so as to allow movement of contact 35 in regards to hole 31.

The tapering of hole 31 in FIG. 1 shows an "hour glass" shaped hole, that is in the form of two cones which overlap at their apex to the extent necessary to accommodate the diameter of movable contact 35, and narrow enough to secure the contact 35. Several other holes would be useful in this regards, depending on the type of irregularities to be accommodated. A single cone would be useful in allowing maximum accommodation at one particular end of movable contact 35. A hole shaped in the form of two wedges joined at their apex would allow movement to be restricted to a single plane about the axis of the midpoint of the movable contact 35. A hole shaped in the form of a single wedge would allow maximum accommodation at a single end with more stability at the other end of movable contact 35. A hole defined by two half-spherical or half-ovoid intrusions would also be useful. A combination of the above holes, as well as other hole variations is also contemplated.

Figure 2C:
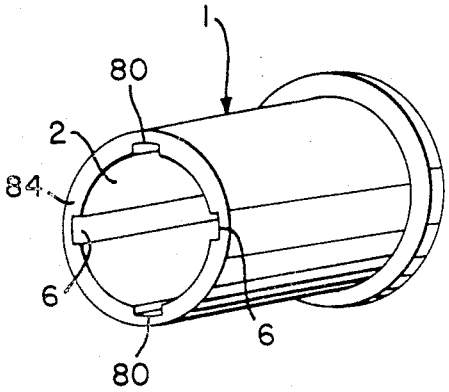
FIG. 2C is a detailed view of the inner casing seen in FIG. 1.

The inner casing 1 is provided with the movable contact 35 receiving holes 6 and with lead piece 10 and 15 receiving holes 80 as shown in FIG. 1 and FIG. 2C. Both pairs of these holes are in the form of grooves which run parallel to the length of the inner casing 1. The pairs of grooves which represent receiving holes 6 face each other and are disposed at a 180 degree angle in regards to the radius of the inner casing 1. The pair of grooves representing the lead piece receiving holes 80 are similarly situated in regards to each other. The two pairs of the grooves representing receiving holes 6 and 80 are situated equidistant from each other at a 90 degree angle with regards to the radius of inner casing 1.

The sealing packing 75 provides stability to the plunger 30 at the distal end by means of cylindrical hole 77. Further, seal packing 75 has rectangular holes 76 into which the distal portion of the lead pieces 10 and 15 are inserted. This allows the contact of lead pieces 10 and 15 with cores 21 of external cord 20. End plate 78 is similarly fitted with rectangular holes 79 to accommodate lead pieces 10 and 15. This configuration serves to secure the free ends of lead pieces 10 and 15, and consequently stabilizes the lead piece-fixed contact-support base assemblage. In addition, the end plate 78 has a diameter slightly larger than the inner diameter of the outer casing 45, and in the switch's assembled state is forced into the outer casing 45. This also provides for stability of the unit.

Bearing member 36 has a face 85 which becomes flush with the facing 84 of the inner casing 1 when the switch is assembled. Additionally, in its assembled state, the face 86 of bearing member 36 projects from the face 87 of outer casing 45. The support base 72 contacts the bearing 36. Further, the inner casing 1 is provided with a face for supporting the bearing 36 and the spring 38.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electrical switch comprising:

a casing having a central bore formed therein;

a pair of fixed contacts disposed longitudinally within said central bore, adjacent the periphery of said casing;

a plunger slideably accommodated in said central bore for movement in an axial direction, said plunger having a continuously conical or wedge shaped hole formed in an intermediate portion thereof;

a bearing member disposed concentric to said plunger and slideably supporting said plunger therein;

a moveable contact fitted within said hole so as to intersect with said fixed contacts, said movable contact being formed by a predetermined length rod member, said hole for receiving said movable contact still having a clearance with respect to the movable contact even after having received the movable contact therein; and a restoring means disposed around the outer periphery of said plunger, said restoring means biasing said movable contact against said fixed contacts, when said switch is in its nonactuated position, so as to prevent said movable contact from pulling out of said hole.

2. An electrical switch as claimed in claim 1, wherein said clearance is in the form of a taper.

3. An electrical switch as claimed in claim 1, wherein said restoring means is a return spring which directly contacts said movable contact.

* * * * *